US009541266B2

(12) United States Patent
Bolscher

(10) Patent No.: US 9,541,266 B2
(45) Date of Patent: Jan. 10, 2017

(54) LUMINAIRE WITH A CONNECTION DEVICE

(71) Applicant: KONINKLIJKE PHILIPS N.V., Eindhoven (NL)

(72) Inventor: Rick Bolscher, Shanghai (CN)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/759,245

(22) PCT Filed: Dec. 16, 2013

(86) PCT No.: PCT/IB2013/060970

§ 371 (c)(1),
(2) Date: Jul. 6, 2015

(87) PCT Pub. No.: WO2014/108774

PCT Pub. Date: Jul. 17, 2014

(65) Prior Publication Data

US 2015/0338068 A1 Nov. 26, 2015

Related U.S. Application Data

(63) Continuation of application No. PCT/CN2013/070218, filed on Jan. 8, 2013.

(51) Int. Cl.
*F21S 4/00* (2016.01)
*F21V 19/00* (2006.01)
(Continued)

(52) U.S. Cl.
CPC ..... *F21V 19/0085* (2013.01); *F21S 2/005* (2013.01); *F21S 4/20* (2016.01); *F21S 4/28* (2016.01);
(Continued)

(58) Field of Classification Search
CPC .... F21V 19/0085; F21V 19/04; F21V 21/005; F21V 23/06; F21S 4/20; F21S 4/28; F21S 2/00; F21S 2/005; Y10T 29/49119; H01R 33/72; F21Y 2103/00
See application file for complete search history.

(56) References Cited

U.S. PATENT DOCUMENTS 5,628,557 A * 5/1997 Huang ..... F21S 2/00 362/125
7,614,764 B2 11/2009 Williams et al.
(Continued)

FOREIGN PATENT DOCUMENTS

DE 29815153 U1 1/1999
EP 1433997 A2 6/2004
(Continued)

*Primary Examiner* — Peggy Neils
*Assistant Examiner* — Alexander Garlen

(57) ABSTRACT

A luminaire (2*a*, 2*b*, 2*c*, 2*d*) comprising a housing with a first end surface (21), a second end surface (22), an at least partially circumferential surface (23) extending between the first end surface and the second end surface, a longitudinal direction (25) extending between the first end surface and the second end surface, and at least one connection device (3*a*, 3*b*; 3*a*', 3*b*'; 3*a*", 3*b*") for connecting the luminaire to a complementary connection device (3*b*, 3*a*; 3*b*', 3*a*'; 3*b*", 3*a*") of another corresponding luminaire, the at least one connection device being arranged on either of the first end surface and the second end surface of the luminaire, the connection device comprising an electrical connection element (34) extending in an angle$\gamma$ with respect to said longitudinal direction (25) of said luminaire, said angle being comprised in the interval (0°; 90°].

11 Claims, 7 Drawing Sheets

(51) Int. Cl.

| | |
|---|---|
| ***F21V 19/04*** | (2006.01) |
| ***F21S 2/00*** | (2016.01) |
| ***F21V 21/005*** | (2006.01) |
| ***F21V 23/06*** | (2006.01) |
| *F21Y 103/00* | (2016.01) |
| *H01R 33/72* | (2006.01) |

(52) U.S. Cl.
CPC ..... *F21V 19/04* (2013.01); *F21V 21/005* (2013.01); *F21V 23/06* (2013.01); *F21S 2/00* (2013.01); *F21Y 2103/00* (2013.01); *H01R 33/72* (2013.01); *Y10T 29/49119* (2015.01)

(56) References Cited

U.S. PATENT DOCUMENTS

| | | | | |
|---|---|---|---|---|
| 7,703,941 | B2 | 4/2010 | Lee | |
| 2009/0296381 | A1 | 12/2009 | Dubord | |
| 2010/0053956 | A1* | 3/2010 | Park | F21K 9/00 362/235 |
| 2010/0124053 | A1 | 5/2010 | Wu et al. | |
| 2011/0164407 | A1 | 7/2011 | Stack et al. | |
| 2011/0286207 | A1 | 11/2011 | Chan et al. | |
| 2012/0008315 | A1 | 1/2012 | Simon et al. | |
| 2012/0075871 | A1* | 3/2012 | Chen | F21S 2/005 362/362 |
| 2012/0092875 | A1* | 4/2012 | Cho | F21S 2/005 362/311.01 |

FOREIGN PATENT DOCUMENTS

| | | | |
|---|---|---|---|
| EP | 1519106 | A2 | 3/2005 |
| EP | 2442008 | A2 | 4/2012 |
| EP | 2444716 | A2 | 4/2012 |
| JP | 3150185 | U | 4/2009 |

* cited by examiner

LUMINAIRE WITH A CONNECTION DEVICE

CROSS-REFERENCE TO PRIOR APPLICATIONS

This application is the U.S. National Phase application under 35 U.S.C. §371 of International Application No. PCT/IB2013/060970, filed on Dec. 16, 2013, which claims the benefit of International Application No. PCT/CN2013/070218 filed on Jan. 8, 2013. These applications are hereby incorporated by reference herein.

FIELD OF THE INVENTION

The invention relates to a luminaire comprising a connection device for connecting the luminaire with another luminaire and to a connection device for connecting luminaires with each other.

BACKGROUND OF THE INVENTION

Luminaires according to the invention are intended for use in any space, indoors or outdoors, where a linear array of luminaires is required for lighting purposes. Particularly, such luminaires are intended for use in lighting systems known as trunking systems or battens.

For several indoor lighting applications, such as shops, warehouses and offices, a linear array of luminaires is applied to give a proper lighting effect for the space. By using different light distributions an optimized lighting solution for these particular indoor applications can be realized. This particular lighting solution is also known as a trunking system. One important element of such linear lighting systems is the easiness of maintenance.

With conventional linear luminaires (using fluorescent technology) 3 general solutions are known. At first, a typical solution is to use a separate trunking, containing a powerline in which luminaires can be connected at specific points. The luminaire for this solution consists of a ballast and lamp. When a luminaire failure occurs, either the luminaire can be disconnected from the powerline and replaced or its failed component, such as a lamp or ballast, can be replaced.

A second known solution is a luminaire comprising connectors at both ends (possibly integrated with the luminaire caps as well). In this case, if a luminaire fails, the luminaire needs to be disconnected from the other luminaires to be replaced.

A last solution of realizing a linear array of luminaires is similar to the second known solution with the difference that the luminaires are connected by means of separate cables. In this case, when a failure occurs the luminaire can be fairly easily replaced by the user.

US 2009/0296381 A1 describes a solution of the second type mentioned above in which a modular lighting system with an elongate light module comprises two end caps. One end cap comprises a male connector and the other end cap a female connector. The connectors each comprise a set of plug-in connector pins for electrically coupling the light module to another light module or to an external power source.

These known solutions pose two main disadvantages. Firstly, by using conventional luminaires, at the end of each luminaire a dark spot is perceived by users due to the required end caps at each end of the luminaire.

Secondly, when the electrical connection of these luminaires are provided in a horizontal way, i.e. in a direction parallel with the longitudinal direction of the luminaire, it is very difficult to replace luminaire(s) placed in the middle of an array of luminaires and having a failure. Particularly, the disconnection of these luminaires implies a distinct risk of damaging the connection device, and on one end of the failed luminaire the entire array of luminaires needs to be moved.

Another way to classify different types of luminaires can be based on electrical properties of the single luminaire, such as maximum voltage or the total number of luminaires connected to a single power supply. Also integrated or using an external power supply can be another way to classify luminaires. For this invention these type of classifications are irrelevant, since the invention can be applied with all types of classifications as described above and the embodiments of the invention is suitable for whatever the building can support electrically.

SUMMARY OF THE INVENTION

It is an object of the present invention to overcome the problems related to dark spots and ease of replacement, and to provide a luminaire with which the dark spot perceived due to the end caps is reduced or even eliminated and with which replacement of luminaires in an array is simplified.

According to a first aspect of the invention, this and other objects are achieved with a luminaire comprising a housing with a first end surface, a second end surface, an at least partially circumferential surface extending between the first end surface and the second end surface, a longitudinal direction extending between the first end surface and the second end surface, and at least one connection device for connecting the luminaire to a complementary connection device of another corresponding luminaire, the at least one connection device being arranged on either of the first end surface and the second end surface of the luminaire, the connection device comprising an electrical connection element extending in an angle $\gamma$ with respect to said longitudinal direction of said luminaire, said angle being comprised in the interval (0°; 90°].

By providing the luminaire with connection devices arranged on respective end surfaces of the luminaire, the luminaire may be provided with simple end surfaces in lieu of the end caps such that end caps as used in the prior art are no longer necessary. Consequently the dark spot associated with such end caps is greatly reduced.

Furthermore, the provision of a connection device with an electrical connection element extending in an angle $\gamma$ with respect to the longitudinal direction of the luminaire, the angle $\gamma$ being comprised in the interval (0°; 90°] provides for a luminaire with which the process of both mounting a new luminaire and replacing a defective luminaire, particularly that or those placed in the middle of an array of luminaires, becomes greatly simplified. Particularly, both mounting a new luminaire and replacing a defective luminaire may with a luminaire according to the invention be carried out in a few simple steps as will be described in further detail below.

In an embodiment the connection device further comprises a first surface, wherein the first surface extends in an angle $\beta$ with respect to the longitudinal direction of the luminaire, the angle $\beta$ being comprised in the interval $0° < \beta < 90°$. Thereby a luminaire is provided which comprises a connection device providing for both mechanical and electrical connection of the luminaire to another luminaire or to an external source of electrical energy.

In an embodiment the electrical connection element is integrated in the first surface, and/or the first surface is chamfered or curved, thereby providing for a luminaire with a connection element of a particularly simple structure.

In an embodiment the connection device further comprises an at least partially circumferential wall extending between the first surface and the second surface. Thereby a luminaire comprising a connection device with a particularly high structural strength and thereby durability is provided.

In an embodiment the connection device further comprises a second surface, the second surface being chamfered or rounded, and wherein the first surface and the second surface meet in a tip point, the location of the tip point on the connection device satisfying the relation $$y_2 \geq y_1 * (1 - \sin \beta),$$

where $y_1$ is the height of the luminaire and $y_2$ is the shortest distance measured in a mounted condition of the luminaire between the tip point and a surface on which the luminaire is mounted.

Thereby a luminaire is provided with which the connection device may be arranged on the luminaire in a position close or adjacent to a rear surface of the luminaire, i.e. in the mounted position close or adjacent to the surface on which the luminaire is mounted. This in turn provides for at least a further reduction or even an elimination of the dark spots which in the prior art were associated with the use of end caps as described above. Furthermore, the provision of a second surface adds further structural strength and thereby durability to the connection device of the luminaire.

In an embodiment the connection device further comprises an engagement element adapted for engagement with a complementary engagement element of another connection device, thereby providing for a particularly robust connection between luminaires or between luminaire and electrical energy source.

Furthermore, the luminaire may comprise two connection devices at opposite end surfaces, one connection device being of a male type and one connection device being of a female type.

According to a second aspect of the invention, the above-mentioned objects and other objects are achieved with a connection device for connecting a luminaire comprising a housing with a first end surface, a second end surface, an at least partially circumferential surface extending between said first end surface and said second end surface, a longitudinal direction extending between said first end surface and said second end surface to a complementary connection device of another corresponding luminaire, the connection device further comprising an electrical connection element, wherein when said connection device is arranged on an end surface of said luminaire, said electrical connection element extends in an angle $\gamma$ with respect to said longitudinal direction of said luminaire, said angle being comprised in the interval (0°; 90°].

Furthermore, according to a third aspect of the invention a method for connecting luminaires according to the invention with each other is provided.

According to a fourth aspect of the invention a method for disconnecting luminaires according to the invention from each other is provided.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

In the drawings.

DETAILED DESCRIPTION

Figure 1:
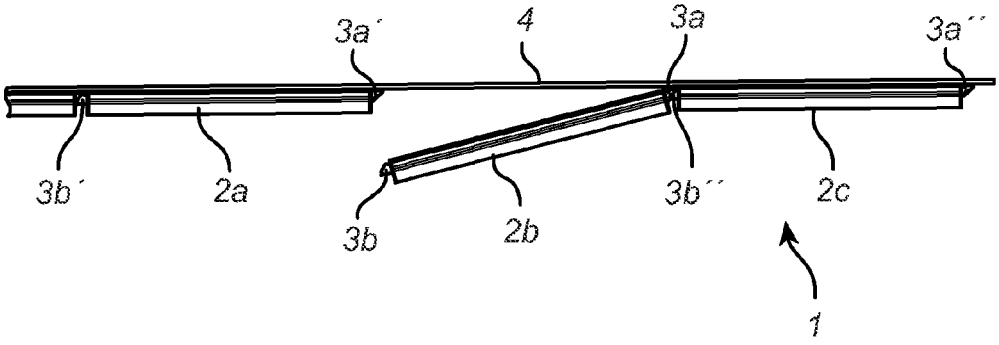
FIG. 1 shows a side view of a light line comprising four luminaires according to the first aspect of the invention mounted on a surface.
Figure 2:
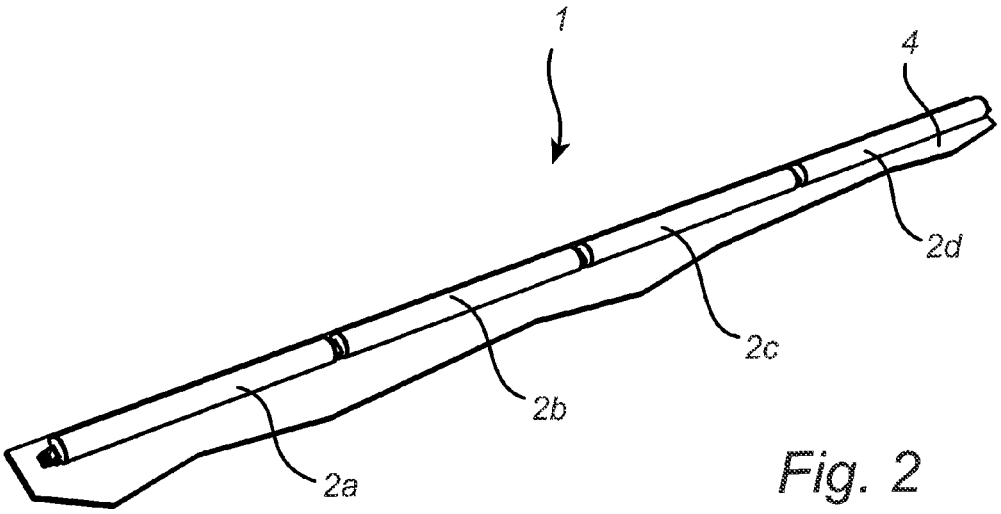
FIG. 2 shows a perspective view of the light line of FIG. 1.

FIGS. 1 and 2 show an array of luminaires 2*a*, 2*b*, 2*c*, 2*d* according to the invention. Such an array shall herein be denoted light line 1. The luminaires 2*a*, 2*b*, 2*c*, 2*d* are mounted on a surface 4 with their rear side 24 towards and their rear surface 26 abutting the surface 4, here being a ceiling (cf. also FIG. 3).

It is noted, however, that the surface 4 may in principle be any feasible type of surface on which it is desired to mount an light line 1, Examples of such surfaces are for instance a ceiling, a wall, a trunking line, a floor or the like.

It is furthermore noted that the luminaire 2*a*, 2*b*, 2*c*, 2*d* may comprise at least one bracket 6 (cf. FIG. 7) for mounting the luminaire on the surface 4.

As is shown on FIG. 1, each luminaire 2*a*, 2*b*, 2*c*, 2*d* of the light line 1 further comprises two connection devices 3*a*, 3*b*; 3*a*', 3*b*'; 3*a*", 3*b*", respectively, for interconnecting the luminaires or for connecting one of the outer luminaires of the light line to a source of electrical energy (not shown). Preferably, one of the connection devices 3*a*; 3*a*'; 3*a*" is of a female type while the other connection device 3*b*; 3*b*'; 3*b*" is of a male type.

As is shown on FIG. 1, the luminaire 2*b* in the middle of the light line 1 is temporarily positioned in an angle with respect to the surface 4 and its connection device 3*b* on the one side is disconnected from the connection device 3*a*' of the luminaire 2*a* adjacent thereto. This particular situation occurs when a user mounts or removes a luminaire, i.e. here the luminaire 2*b*, in or from the light line 1. The luminaire 2*b* and the luminaire 2*c* adjacent thereto and opposite the luminaire 2*a* are mechanically and electrically connected by means of the respective connection devices 3*a* and 3*b*".

The luminaire and/or the connection device according to the invention may be moulded, preferably in a plastic material. Furthermore, the luminaire and/or the connection device may be one integral device.

The luminaire according to the invention is an elongated luminaire that may have any feasible configuration such as linear, curved, U-shaped, S-shaped, ring-shaped etc. Also, the luminaire according to the invention may have any feasible cross sectional shape. Likewise the light line 1 may have any feasible overall configuration such as linear, curved, U-shaped, S-shaped, ring-shaped etc.

Figure 3:
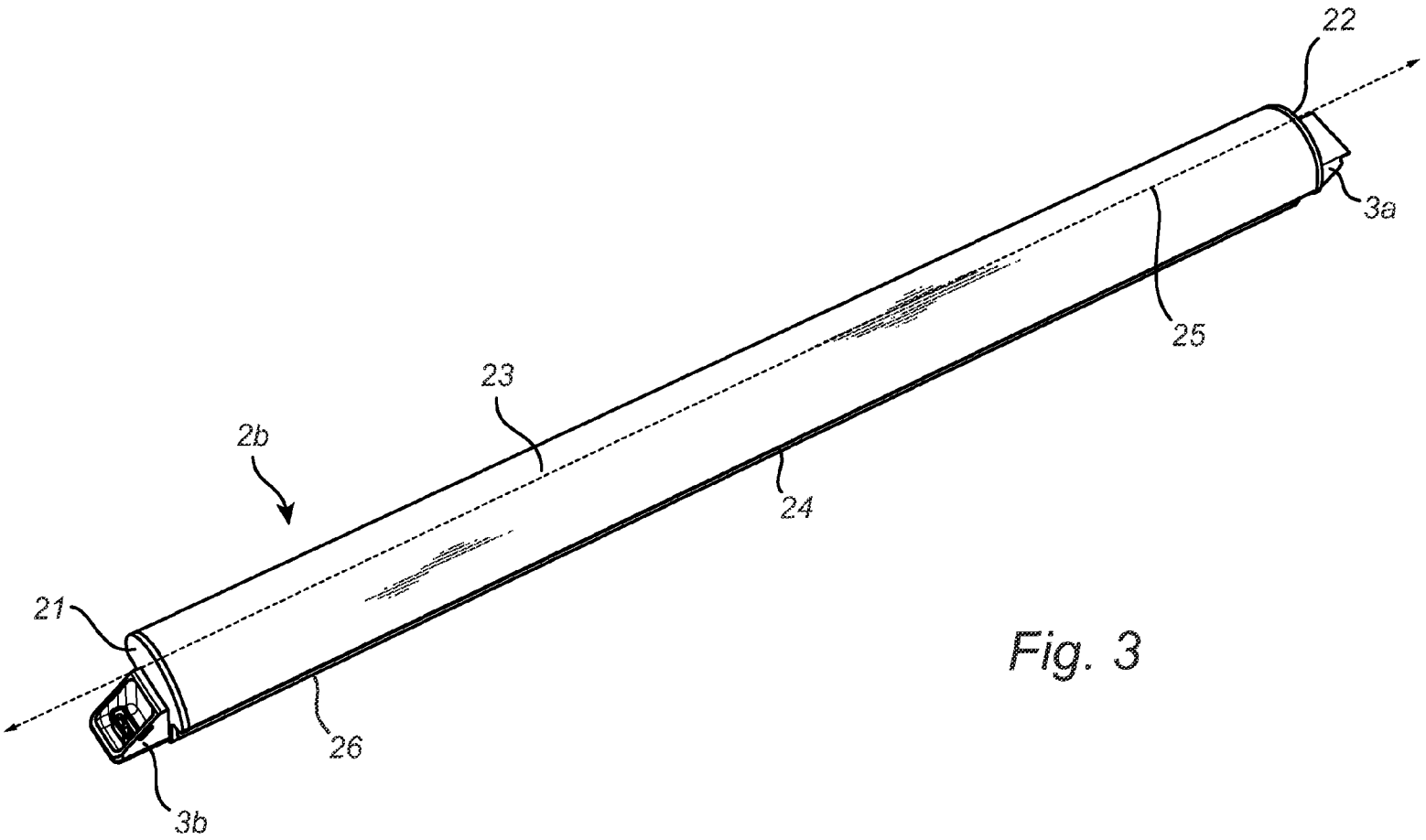
FIG. 3 shows a perspective view of a first embodiment of a luminaire according to the invention comprising two connection devices according to the second aspect of the invention.

Turning now to FIG. 3 a luminaire 2*b* according to the invention is shown in further detail. The luminaire comprises a housing which comprises a first end surface 21, a second end surface 22, and an at least partially circumferential surface 23 extending between the first end surface 21 and the second end surface 22. The housing further comprises a longitudinal direction 25 extending between the first end surface 21 and the second end surface 22. Preferably, but not necessarily, the longitudinal direction 25 furthermore extends perpendicular to the first end surface 21 and the second end surface 22. The at least partially circumferential surface 23 further comprises a front side 23 and a rear side 24, the rear side 24 comprising a rear surface 26.

Along with the possible configurations mentioned above, another configuration of the luminaire is that the longitudinal direction 25 need not necessarily be linear in its extension, but may be flexible in its extension to create any desired shape of the luminaire such as e.g. curved or angled.

The front side 23 and/or rear side 24 of the luminaire may be transparent or diffuse to allow light from a light source (not shown) arranged within said luminaire pass through.

In the embodiment shown in FIG. 3, the rear surface 26 is adapted for abutment with and/or connection with a surface 4 on which it is intended to mount the luminaire 2*b*. Furthermore, in case of a luminaire with a circular or oval cross section the rear surface 26 may be a line adapted for abutment against a surface 4 on which the luminaire is mounted.

Figure 7:
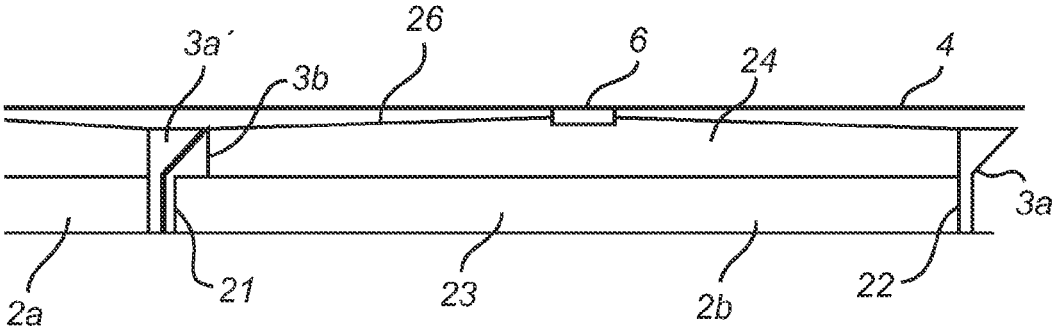
FIG. 7 shows a side view of a second embodiment of a luminaire according to the invention comprising two connection devices according to the invention.

In embodiments such as the one shown in FIG. 7 where the luminaire comprises a mounting bracket 6, the rear surface 26 is adapted for facing a surface 4 on which it is intended to mount the luminaire 2*b*.

The luminaire 2*b* further comprises two connection devices 3*a*, 3*b*, one on each end surface 21, 22, for connecting the luminaire 2*b* to another corresponding luminaire or for connecting it to a source of electrical energy (not shown). One of the connection devices 3*a* is of a female type while the other connection device 3*b* is of a male type.

It is noted that the luminaire according to the invention may comprise any other number of connection devices that two, e.g. one or three, thereby allowing for other configurations of a light line. Also, a connection device may in principle be arranged on the at least partially circumferential surface 23 of the luminaire.

Figure 4:
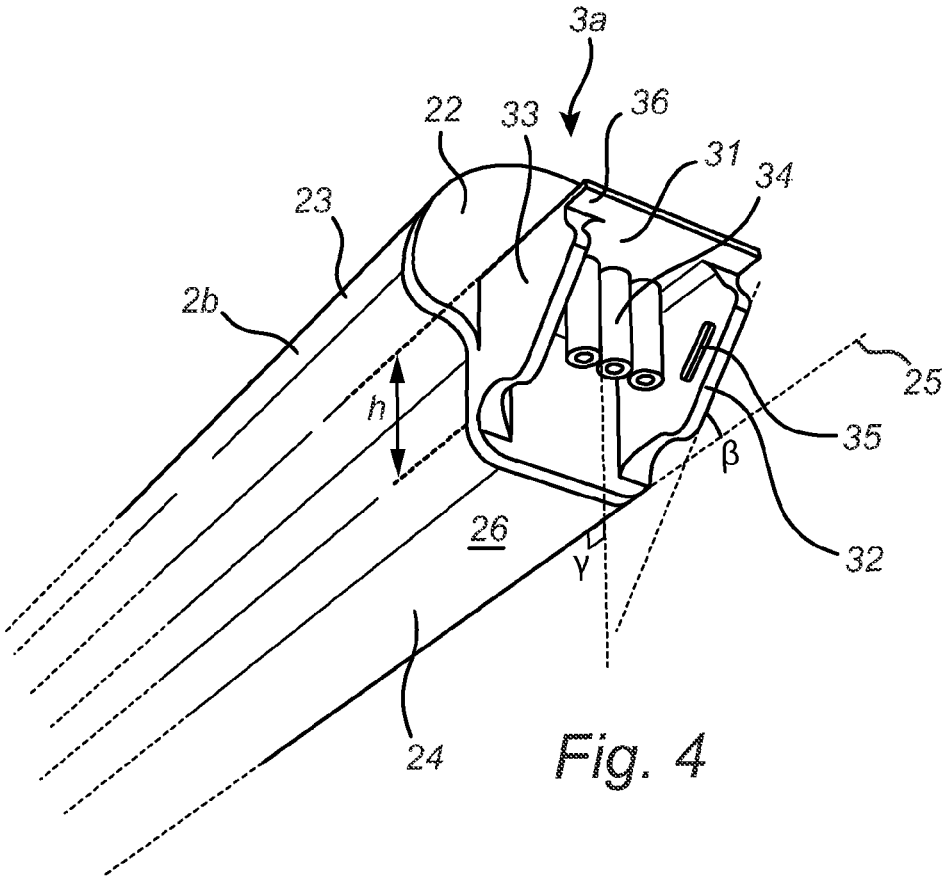
FIG. 4 shows a perspective view of a connection device according to the second aspect of the invention in a male version.
Figure 5:
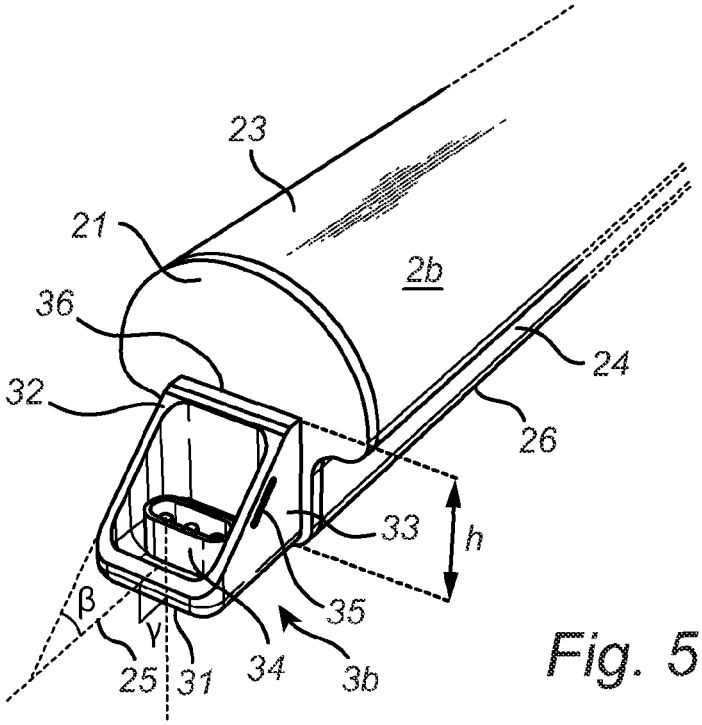
FIG. 5 shows a perspective view of a connection device according to the second aspect of the invention in a female version.

An embodiment of a connection device according to the invention will now be described in detail with reference to FIG. 4 showing a connection device 3*b* is of a male type, FIG. 5 showing a connection device 3*a* of a female type and FIG. 6.

Figure 6:
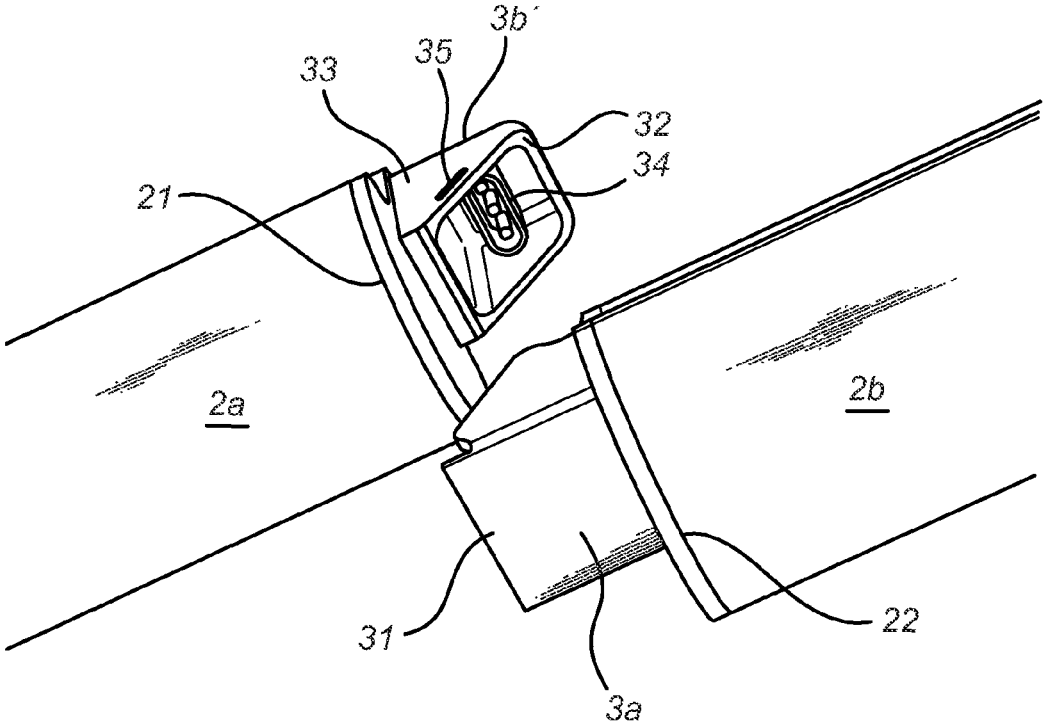
FIG. 6 shows a perspective view of two luminaires according to the first embodiment of the invention comprising a connection device according to the second aspect of the invention in a male version and a female version, respectively, just before being connected with each other.

In the embodiment shown in FIGS. 4, 5 and 6 the connection device 3*a*, 3*b* comprises, irrespective of being of female or male type:

a first surface 32,
a second surface 31,
an at least partially circumferential wall 33 extending between the first surface 32 and the second surface 31,
an electrical connection element 34,
an engagement means 35, and
an abutment surface 36.

It is noted that a connection device 3*a*, 3*a*', 3*a*" of the female type according to the invention comprises an opening in the first surface 32 adapted for receiving the first surface 32 of a connection device 3*b*, 3*b*', 3*b*" of the male type according to the invention.

Figure 8:
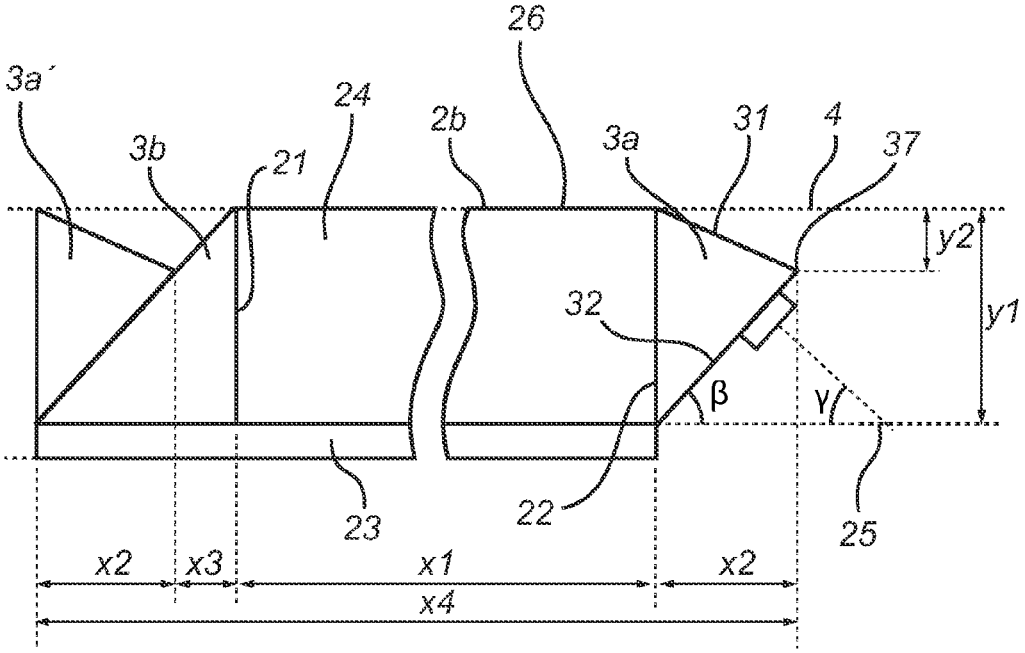
FIG. 8 shows a schematic view of a luminaire according to the invention illustrating different dimensions of the luminaire and comprising a connection device comprising a chamfered second surface.

It is noted that with the exception of the first surface 32 all of the elements 31 to 36 of the connection device 3*a*, 3*b* are in principle optional and may in different embodiments be present or not independently of one another. Furthermore, as shown in FIG. 8, the first surface 32 and the second surface 31 may be merged and the electrical connection element 34 may be arranged perpendicular to the first surface 32.

Furthermore, the connection device 3*a*, 3*b* comprises a height h. The height h of the connection device 3*a*, 3*b* is defined as the largest distance between the first surface 32 and the second surface 31 of the connection device 3*a*, 3*b*.

The first surface 32 of the connection device 3*a*, 3*b* extends in an angle β with respect to the longitudinal direction 25 of the luminaire 2*b*.

The angle β may be expressed as being the angle between the direction in which the first surface 32 extends and a longitudinal direction 25 of the luminaire.

Alternatively the same angle β may be expressed as being the angle between the direction in which the first surface 32 extends and a direction extending perpendicular to the direction of the height h of the connection device.

The angle β is comprised in the interval $0° < \beta < 90°$. In principle the angle β may alternatively be comprised in any other interval being a sub-interval of the interval $0° < \beta < 90°$. For example, the angle β may alternatively be comprised in the interval $10° < \beta < 80°$, in the interval $20° < \beta < 70°$ or in the interval $30° < \beta < 60°$.

The first surface 32 of the connection device 3*a*, 3*b* may be circumferential as shown in FIG. 5, or it may comprise two segments as shown in FIG. 4. The first surface 32 may furthermore be substantially planar as shown in FIG. 5, or it may be curved as shown in FIG. 4.

In the embodiment shown on FIGS. 4 to 6 the second surface 31 of the connection device 3*a*, 3*b* extends in parallel with the longitudinal direction 25 of the luminaire. The second surface 31 must, however, not necessarily be parallel with the longitudinal direction 25, but may in other embodiments be curved or chamfered.

The at least partially circumferential wall 33 of the connection device 3*a*, 3*b* extends between the first surface 32 and the second surface 31 connecting the first surface 32 and the second surface 31 along at least a part of their periphery. The at least partially circumferential wall 33 may be comprised of two opposite side walls as shown in FIG. 4, or it may be substantially peripheral as shown in FIG. 5. Also, a wide number of other configurations of the at least partially circumferential wall 33, such as for instance one or more wall segments or a grid-like structure, are feasible.

The electrical connection element 34 of the connection device 3*a*, 3*b* generally extends in an angle γ with respect to the longitudinal direction 25 of the luminaire 2*b*, which angle γ is comprised in the interval (0°; 90°]. As shown in FIGS. 4 to 6 the angle γ in which the electrical connection element 34 extends with respect to the longitudinal direction 25 is 90°. Alternatively the angle γ in which the electrical connection element 34 extends with respect to the longitudinal direction 25 of the luminaire 2*b* may be comprised in the interval [2°; 80°] or in the interval [2°; 70°].

In terms of the height h of the connection device 3*a*, 3*b*, the electrical connection element 34 may also be described as extending in an angle with respect to the height h, said angle being comprised in the interval [0°; 90°). In these terms and as shown in FIGS. 4 to 6 the angle in which the electrical connection element 34 extends with respect to the height h is 0°.

The electrical connection element 34 of the male type connection device 3*b* (FIG. 4) is of a male type, while the electrical connection element 34 of the female type connection device 3*a* (FIG. 5) is of a female type. The electrical connection element 34 comprises at least one electrically conductive material, which is preferably surrounded by at least one non-conductive material. The total number of different conductive materials surrounded by non-conductive materials may vary, typically from 2 towards a maximum of 12. As known in the field of luminaire design, the connection element 34 is designed in such a way that when higher voltages are applied, the conductive material cannot be touched by bare hands.

In the embodiment shown on FIGS. 4 to 6, the male type electrical connection element comprises three cylindrical pins, each with a central cavity having walls made of, or covered by an electrically conductive material, whereas the female type electrical connection element comprises a sheath with three pins of an electrically conductive material, the pins fitting the cavities of the male type electrical connection element The electrical connection element 34 as shown on the figures, particularly FIGS. 4 and 5, is to be construed as one possible embodiment amongst a wide variety of possible embodiments. In principle the electrical connection element 34 may be any feasible type of connection element providing an electrical connection. Possible types include, but are not limited to, pin and plug connectors, planar terminals forming an electrical connection when brought into abutment with each other and spring biased connectors, e.g. of the pogo-pin type.

Preferably, however, electrical connection elements of a type following the norm IEC 60320 specifying non-locking electrical power couplers for the connection of power supply cords to electrical appliances up to 250 V are employed as the electrical connection element 34.

Figure 11:
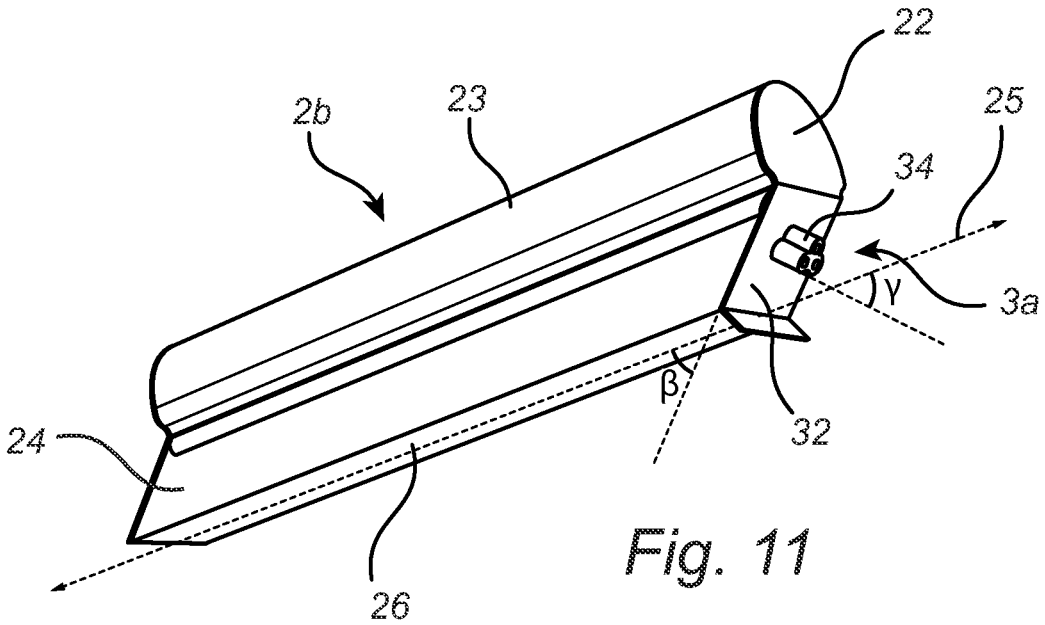
FIG. 11 shows a perspective view of a third embodiment of a luminaire according to the invention comprising a male type connection device according to the invention.
Figure 12:
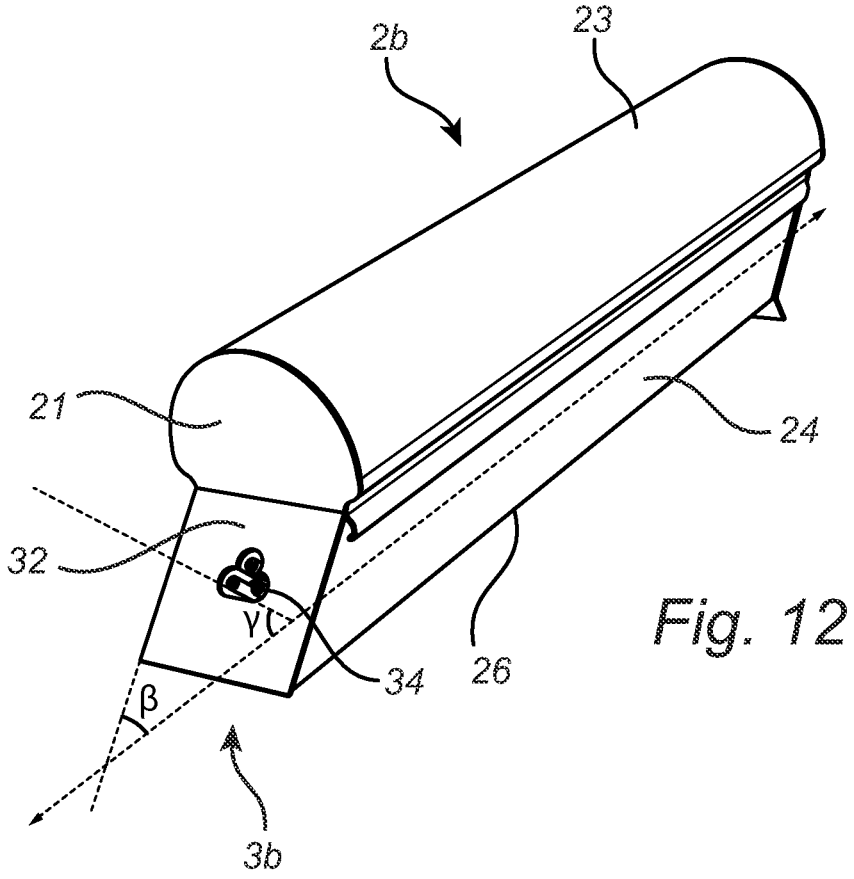
FIG. 12 shows a perspective view of a third embodiment of a luminaire according to the invention comprising a female type connection device according to the invention.

In an alternative embodiment the electrical connection element 34 may be integrated in the first surface 32 of the connection device—e.g. as shown on FIGS. 11 and 12.

Furthermore, the connection device according to the invention may be adapted to transfer communication signals, which signals could be part of different communication protocols (e.g. DALI, DMX).

The engagement element 35 of the connection device 3*a*, 3*b* shown on FIGS. 4 and 5 comprises a protrusion (FIG. 4) and a corresponding recess (FIG. 5), thus forming a snap-locking engagement element 35 providing for locking the connection devices 3*a*, 3*b* in a snap-locking manner when brought into mutual engagement. In principle, however, any other feasible type of engagement element 35 may be employed. Possible types include, but are not limited to, engagement elements of the pin and hole type and of the friction-locking type.

In an alternative embodiment (not shown) the engagement element 35 may be integrated in the first surface 32 of the connection device.

The abutment surface 36 of the connection device 3*a*, 3*b* is adapted for mutual abutment when the connection devices 3*a*, 3*b* are in full engagement with each other. The abutment surface 36 serves as a stop indicating to a user when full engagement is achieved. Such an indication is especially advantageous in embodiments in which the engagement element 35 is omitted.

Turning now to FIG. 8 an alternative embodiment of a connection device 3*a* of a luminaire 2*b* according to the invention is shown. The connection device 3*a* shown in FIG. 8 differs from the above embodiment in one aspect which will be described in the following.

In the embodiment according to FIG. 8, the second surface 31 of the connection device 3*a* is chamfered or rounded in such a way that the first surface 32 and the second surface 31 meet in a tip point 37. The location of the tip point 37 on the connection device 3*a* satisfies the relation $$y_2 \geq y_1 * (1 - \sin \beta),$$

where $y_1$ is the height of the luminaire and $y_2$ is the shortest distance measured in a mounted condition of said luminaire between the tip point 37 and a surface 4 on which the luminaire is mounted.

Such a rounded or chamfered second surface 31 makes it possible to mount the connecting device 3*a* on the luminaire 2*b* in such a way that at least an edge of the connecting device 3*a* is flush with the rear surface 26, while still maintaining the advantages described above.

The distance $y_2$ may as mentioned be described as the shortest distance measured in a mounted condition of said luminaire between the end point 37 and a surface 4 on which the luminaire is mounted. This applies whether the luminaire comprises a mounting bracket 6 or not. Alternatively, in embodiments where the luminaire does not comprise a mounting bracket 6, the distance $y_2$ may be seen as the shortest distance between a plane in which a rear surface 26 of said luminaire extends and the end point 37. Alternatively, in embodiments where the luminaire comprises a mounting bracket 6, the distance $y_2$ may be described as the sum of shortest distance between a plane in which a rear surface 26 of said luminaire extends and the end point 37 and the largest thickness of the mounting bracket 6.

FIG. 8 also serves to illustrate the relationship between different dimensions of a luminaire according to the invention. FIG. 8 illustrates the following dimensions extending in parallel with the longitudinal direction of a luminaire according to the invention:

the length of the housing of the luminaire 2*b*, $x_1$,
the length of the connection device 3*a*, $x_2$,
the length of the connection device 3*b*, $x_2+x_3$, and
the total length of the luminaire 2*b*, $x_4$, Expressed by means of the angle β and the two dimensions $y_1$ and $y_2$ as described above, the following relations apply:

$$x_2 = y_1 * \cos \beta,$$

$$x_2 + x_3 = y_1 * \cos \beta + y_2 * \tan \beta$$

$$x_4 = x_1 + 2 * x_2 + x_3 = x_1 + 2 * (y_1 * \cos \beta) + y_2 * \tan \beta$$

Furthermore, expressed by means of the angle β and the height of the luminaire $y_1$ as described above, the following relation applies to the minimum length, $l_m$, of the luminaire:

$$l_m = y_1 * (\tan\beta + 1/(2*\cos\beta) - (1/(2*\sin\beta*\cos\beta)) + \cos\beta + 1/\tan\beta)$$

for $0<\beta<90$ degrees and $0<y_1$.

FIGS. 11 and 12 show an alternative embodiment of a luminaire 2*b* according to the invention. In this embodiment the first surface 32 of the connection device 3*a*, 3*b* is provided as or coincides with an inclined surface part of the respective end surface 21, 22 of the luminaire 2*b*. As in the other embodiments, the first surface 32 of the connection device 3*a*, 3*b* extends in the angle β with respect to the longitudinal direction 25 of the luminaire 2*b*. Likewise, as in the other embodiments, the electrical connection element 34 of the connection device 3*a*, 3*b* generally extends in the angle γ with respect to the longitudinal direction 25 of the luminaire 2*b*. When two luminaires according to this third embodiment of the invention are connected with each other, the first surfaces 32 of the respective connection devices 3*a*, 3*b* abut each other and the non-inclined surface parts of the respective end surface 21, 22 (on FIGS. 11 and 12 adjacent the at least partially circumferential surface 23 of the luminaire) likewise abut each other. In other words the non-inclined surface part of the end surface 21 or 22 together with the first surface 32 form a surface of the connection element 3*a* or 3*b* being adapted for abutting a similar surface of a corresponding connection device. Hence, in the case shown in FIGS. 11 and 12 the height h of the connection device 3*a*, 3*b* equals the height y1 of the luminaire.

Figure 9:
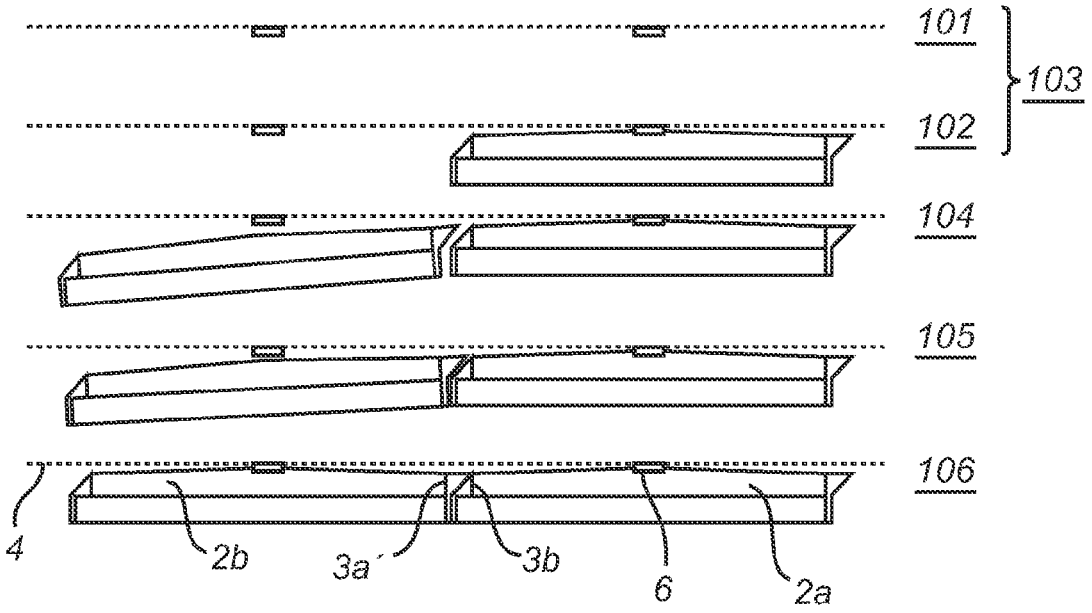
FIG. 9 shows a schematic illustration of the steps of a method according to the third aspect of the invention for connecting luminaires with each other.

With reference now to FIG. 9 a method for mechanically and electrically connecting at least two luminaires according to the invention with each other will be described to illustrate the increased simplicity of the process provided by the present invention. The method is described in relation to luminaires 2*a*, 2*b*, 2*c*, 2*d* each comprising one mounting bracket 6. It is noted, however, that the method applies to luminaires without mounting brackets too, in which case the steps related to the mounting brackets should simply be omitted.

When connecting at least two luminaires 2*a*, 2*b*, 2*c*, 2*d* according to the invention with each other, a user will perform the following steps both for luminaires with and without mounting brackets:

- providing at least two luminaires 2*a*, 2*b*, 2*c*, 2*d* according to the invention,
- at step 102 mounting a first luminaire 2*a* in a first fixed position on a surface 4, and
- mechanically and electrically connecting a subsequent luminaire 2*b* to the first luminaire 2*a*, by performing the steps of:
  - at step 104 guiding a connection device 3*a; 3b* of the subsequent luminaire into a position above a complementary connection device 3*b; 3a* of the first luminaire,
  - at step 105 bringing the connection device 3*a; 3b* of the subsequent luminaire into mechanical and electrical connection with the complementary connection device 3*b; 3a* of the first luminaire by rotating the subsequent luminaire 2*b* in such a way that the connection device 3*a; 3b* of the subsequent luminaire is brought into physical and electrical contact with the complementary connection device 3*b; 3a* of the first luminaire, and
  - at step 106 mounting the subsequent luminaire 2*b* in a second fixed position on the surface.

For a luminaire comprising a mounting bracket 6 the user will furthermore as illustrated at 103 on FIG. 9 perform the following steps when connecting at least two luminaires 2*a*, 2*b*, 2*c*, 2*d* according to the invention with each other: providing at least one mounting bracket 6, at step 101 mounting a mounting bracket in the first fixed position and/or in the second fixed position on the surface, and at step 102 and/or as a part of step 105 mechanically connecting the first luminaire 2*a* and/or the second luminaire 2*b* to the mounting bracket.

Figure 10:
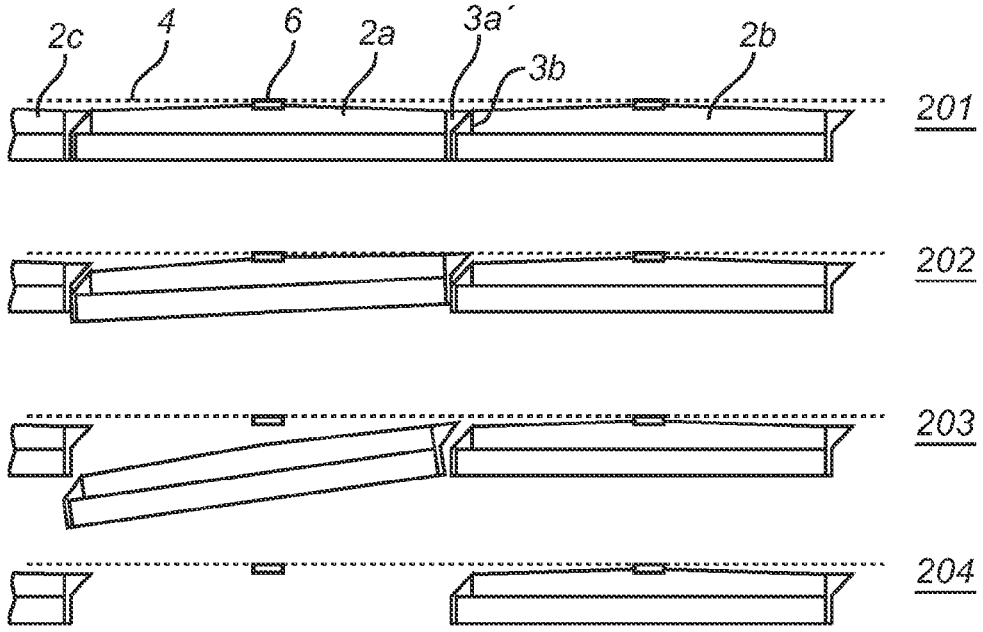
FIG. 10 shows a schematic illustration of the steps of a method according to the fourth aspect of the invention for disconnecting luminaires from each other.

Finally, with reference now to FIG. 10 a method for mechanically and electrically disconnecting at least two luminaires according to the invention from each other will be described to illustrate the increased simplicity of the process provided by the present invention. The method is described in relation to luminaires 2*a*, 2*b*, 2*c*, 2*d* each comprising one mounting bracket 6. It is noted, however, that the method applies to luminaires without mounting brackets too, in which case the steps related to the mounting brackets should simply be omitted.

When disconnecting at least two luminaires 2*a*, 2*b*, 2*c*, 2*d* according to the invention from each other, a user will perform the following steps both for luminaires with and without mounting brackets:

- at step 201 providing at least two luminaires 2*a*, 2*b*, 2*c*, 2*d* according to the invention, each being mounted in a fixed position on a surface 4,
- at step 202 bringing a connection device 3*a; 3b* of a first luminaire 2*a* out of mechanical and electrical connection with a complementary connection device 3*b; 3a* of a subsequent luminaire 2*b* by rotating the first luminaire 2*a* in such a way that the connection device 3*a; 3b* of the first luminaire 2*a* is brought towards the surface in such a way that the connection device 3*a; 3b* of the subsequent luminaire is brought out of physical and electrical contact with the complementary connection device 3*b; 3a* of the first luminaire,
- at step 203 demounting the first luminaire 2*a* from the fixed position on the surface in which it is mounted, and
- at step 204 removing the first luminaire 2*a* from the surface and the subsequent luminaire 2*b*.

In case the first luminaire 2*a* and/or the subsequent luminaire 2*b* is mounted in the fixed position on the surface 4 by means of mechanical connection with at least one mounting bracket 6 the user will furthermore as a part of the step 203 of demounting the first luminaire 2*a* from the fixed position on the surface, mechanically disconnect the first luminaire 2*a* from the at least one mounting bracket 6.

The person skilled in the art realizes that the present invention by no element is limited to the preferred embodiments described above. On the contrary, many modifications and variations are possible within the scope of the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A luminaire comprising:

a housing with a first end surface, a second end surface, an at least partially circumferential surface extending between said first end surface and said second end surface, a longitudinal direction extending between said first end surface and said second end surface, and at least one connection device for connecting said luminaire to a complementary connection device of another corresponding luminaire, said at least one connection device being arranged on either of said first end surface and said second end surface of said luminaire, said connection device comprising an electrical connection element extending in an angle γ with respect to said longitudinal direction of said luminaire, said angle being comprised in the interval (0°; 90°];

wherein said connection device further comprises a first surface, wherein said first surface extends in an angle β with respect to said longitudinal direction of said luminaire, said angle β being comprised in the interval $0° < \beta < 90°$;

wherein said connection device further comprises a second surface, said second surface being rounded, and wherein said first surface and said second surface meet in a tip point, the location of the tip point on the connection device satisfying the relation $$y2 \geq y1*(1-\sin \beta),$$

where y1 is the height of the luminaire and y2 is the shortest distance measured in a mounted condition of said luminaire between said tip point and a surface on which the luminaire is mounted.

2. A luminaire according to claim 1, wherein said electrical connection element is integrated in the first surface.

3. A luminaire according to claim 1, wherein said connection device further comprises an at least partially circumferential wall extending between said first surface and said second surface.

4. A luminaire according to claim 1, wherein said connection device further comprises an engagement element adapted for engagement with a complementary engagement element of another connection device.

5. A luminaire according to claim 1, comprising two connection devices at opposite end surfaces, wherein one connection device being of a male type and one connection device being of a female type.

6. A luminaire according to claim 1, wherein the first surface is curved.

7. A method for mechanically and electrically connecting at least two luminaires with each other, comprising the steps of:

providing at least two luminaires according to claim 1, mounting a first luminaire in a first fixed position on a surface, and mechanically and electrically connecting a subsequent luminaire to said first luminaire, wherein the step of mechanically and electrically connecting said subsequent luminaire comprises the steps of:

guiding a connection device of said subsequent luminaire into a position above a complementary connection device of said first luminaire, bringing said connection device of said subsequent luminaire into mechanical and electrical connection with said complementary connection device of said first luminaire by rotating said subsequent luminaire in such a way that said connection device of said subsequent luminaire is brought into physical and electrical contact with said complementary connection device of said first luminaire, and mounting said subsequent luminaire in a second fixed position on said surface.

8. A method according to claim 7, wherein said step of mounting a first luminaire in a first fixed position on a surface comprises:

providing at least one mounting bracket, mounting a mounting bracket in said first fixed position on said surface, and mechanically connecting said first luminaire to said mounting bracket.

9. A method according to claim 7, wherein said step of mounting said subsequent luminaire in a second fixed position on said surface comprises:

providing at least one mounting bracket, mounting a mounting bracket in said second fixed position on said surface, and mechanically connecting said second luminaire to said mounting bracket.

10. A method for mechanically and electrically disconnecting at least two luminaires with each other, comprising the steps of:

providing at least two luminaires according to claim 1, each being mounted in a fixed position on a surface, bringing a connection device of a first luminaire out of mechanical and electrical connection with a complementary connection device of a subsequent luminaire by rotating said first luminaire in such a way that said connection device of said first luminaire is brought towards said surface in such a way that said connection device of said subsequent luminaire is brought out of physical and electrical contact with said complementary connection device of said first luminaire, demounting said first luminaire from said fixed position on said surface in which it is mounted, and removing said first luminaire from said surface and said subsequent luminaire.

11. A method according to claim 10, wherein said first luminaire is mounted in said fixed position on said surface by means of mechanical connection with a mounting bracket, and wherein said step of demounting said first luminaire from said fixed position on said surface comprises mechanically disconnecting said first luminaire from said mounting bracket.

* * * * *